US008479615B2

(12) United States Patent
Wojick

(10) Patent No.: US 8,479,615 B2
(45) Date of Patent: Jul. 9, 2013

(54) SELF-CLAMPING WRENCH

(76) Inventor: Robert John Terence Wojick, Ontario (CA)

( * ) Notice: Subject to any disclaimer, the term of this patent is extended or adjusted under 35 U.S.C. 154(b) by 562 days.

(21) Appl. No.: 12/636,293

(22) Filed: Dec. 11, 2009

(65) Prior Publication Data

US 2011/0138972 A1 Jun. 16, 2011

(30) Foreign Application Priority Data

Nov. 18, 2009 (CA) ..... 2686026

(51) Int. Cl.
*B25B 13/28* (2006.01)

(52) U.S. Cl.
USPC ..... 81/90.4; 81/90.5; 81/57.34; 192/45

(58) Field of Classification Search
USPC ..... 81/90.4, 90.5–90.7, 59.1
See application file for complete search history.

(56) References Cited

U.S. PATENT DOCUMENTS

| | | | | |
|---|---|---|---|---|
| 791,814 | A * | 6/1905 | Pitzer | 81/90.4 |
| 807,258 | A | 12/1905 | Foggan | |
| 1,456,480 | A * | 5/1923 | Becker | 81/383 |
| 1,483,486 | A * | 2/1924 | Scott | 81/90.4 |
| 1,593,000 | A * | 7/1926 | Wilson | 81/90.5 |
| 1,855,325 | A * | 4/1932 | Stone, Sr. et al. | 81/90.4 |
| 2,099,601 | A | 11/1937 | Fields | |
| 2,339,760 | A * | 1/1944 | Boynton | 81/90.4 |
| 2,510,813 | A | 6/1950 | Gean | |
| 2,576,203 | A | 11/1951 | Wilson | |
| 3,256,757 | A * | 6/1966 | Kochaver | 81/57.34 |
| 3,662,867 | A * | 5/1972 | Kinzbach | 192/45.004 |
| 4,631,990 | A | 12/1986 | Hughes | |
| 7,246,541 | B1 | 7/2007 | Divack | |

FOREIGN PATENT DOCUMENTS

| | | |
|---|---|---|
| CA | 2411595 | 7/1943 |
| WO | 96/35553 | 11/1996 |

OTHER PUBLICATIONS

Product Website (http://www.bgitool.corm/nuclear_tooling.html) for Sure Grip Wrench.
Office Action of Canadian Intellectual Property Office for Canadian Application No. 2,686,026 Dated Dec. 7, 2011 (2 pages).

* cited by examiner

*Primary Examiner* — Monica Carter
*Assistant Examiner* — Melanie Alexander
(74) *Attorney, Agent, or Firm* — Dority & Manning, P.A.

(57) ABSTRACT

A wrench comprising an elongated handle having a proximal end and first and second pivots at a distal end, and a spring-loaded latch pivotally connected to the second pivot, the latch being movable about the second pivot from an unlocked position to a locked position. The wrench includes a first clamping jaw having a first end pivotally connected to the handle at the first pivot and having a second end that includes a third pivot. A second clamping jaw is pivotally connected to the first clamping jaw via the third pivot to constitute with the first clamping jaw an articulated clamping jaw. The second clamping jaw has a free end for displacing the spring-loaded latch from the unlocked position to the locked position. The latch locks the free end of the second clamping jaw when the free end of the second clamping jaw has pushed past the latch.

9 Claims, 3 Drawing Sheets

SELF-CLAMPING WRENCH

CROSS-REFERENCE TO RELATED APPLICATIONS

This application claims priority from Canadian Patent Application Serial Number 2,686,026 which was filed Nov. 18, 2009 bearing the same title.

TECHNICAL FIELD

The present technology relates generally to wrenches and, in particular, to wrenches designed to clamp onto a cylindrical object.

BACKGROUND

Wrenches are tools that are designed to apply torque to an object. Many types of wrenches are known in the art. One specific type of wrench, referred to herein as a clamping wrench, is designed to clamp onto the cylindrical outer surface of an object in order to enable a user or operator to apply a torque to the object. One specific example of a clamping wrench is an innertube wrench used for disconnecting an innertube from a drill string.

The clamping wrenches, and particularly the innertube wrenches, known in the art have a pair of clamping arms that are manually latched together to tightly grip the cylindrical outer surface. Typically, two such wrenches are required for applying a torque. However, a problem arises when only a single operator has to use two wrenches, as each wrench requires two hands to latch together. Thus, the lone operator cannot simultaneously latch together the two clamping arms of the second wrench while holding the first wrench. If the first wrench is let go, the latch disconnects, thus making it extremely frustrating and exasperating for the single operator to disconnect the innertube from a drill string. This same problem arises when using these manually operated clamping wrenches in other contexts as well. Because these clamping wrenches are so difficult to operate, two workers are often required, which is economically inefficient. This has remained a technical problem for which an adequate solution has yet to be devised.

SUMMARY

In general, the present invention provides a self-clamping wrench that has an articulated pair of clamping jaws pivotally connected to a handle of the wrench. When the wrench is swung onto a cylindrical or tubular object, the first jaw engages one side of the cylindrical or tubular object. Because the second jaw is pivotally connected to the first jaw, the second jaw pivots ("whips around") the other side of the cylindrical or tubular object until a free end of the second clamping jaw engages a spring-loaded latch pivotally mounted to the handle. When the free end pushes past this spring-loaded latch, the second clamping jaw becomes locked. The first and second clamping jaw, when locked, tightly grip the cylindrical or tubular object within semi-circular (round) gripping portions. To unlock the second clamping jaw from the first clamping jaw, the latch is pressed inwardly, i.e. against the outward force exerted by the spring, to thereby release the free end of the second clamping jaw from the latch. The wrench can then be removed from the object.

Thus, a main aspect of the present invention is a wrench comprising an elongated handle having a proximal end and a distal end. The handle has a first pivot at the distal end and a second pivot also at the distal end. The handle also has a spring-loaded latch pivotally connected to the second pivot. The latch is movable about the second pivot from an unlocked position to a locked position. The wrench further includes a first clamping jaw having a first end pivotally connected to the handle at the first pivot and having a second end that includes a third pivot. The wrench further includes a second clamping jaw pivotally connected to the first clamping jaw via the third pivot to constitute with the first clamping jaw an articulated clamping jaw. The second clamping jaw has a free end for displacing the spring-loaded latch from the unlocked position to the locked position. The latch locks the free end of the second clamping jaw when the free end of the second clamping jaw has pushed past the latch.

In certain embodiments of the invention, the wrench includes a jaw-positioning mechanism that the user employs to open, set or pre-position one of the jaws prior to clamping the wrench onto an object.

Another aspect of the present invention is a method for applying torque to a substantially cylindrical object. The method entails gripping an elongated handle of a wrench having first and second clamping jaws that are pivotally connected to form an articulated clamping jaw that is also pivotally mounted at a proximal end of the first clamping jaw to a distal end of the handle. The method then involves swinging the wrench to cause the first clamping jaw to contact one side of the cylindrical object, thus causing the second clamping jaw pivotally connected to the first clamping jaw to pivot around the cylindrical object until a free end of the second clamping jaw engages a spring-loaded latch pivotally mounted to the handle, thereby locking the second clamping jaw to the first clamping jaw to tightly grip the cylindrical object between the first and second clamping jaws. Finally, the method then involves rotating the wrench to thereby apply torque to the cylindrical object.

The details and particulars of these aspects of the invention will now be described below, by way of example, with reference to the attached drawings.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION

By way of general overview, the present invention provides a self-clamping wrench. This wrench has a first (upper) jaw and a second (lower) jaw that are pivotally connected together to define an articulated clamping jaw. This articulated clamping jaw is itself pivotally connected to a handle of the wrench so that when the wrench is swung onto a cylindrical or tubular object, the first (upper) jaw engages the top side of the cylindrical or tubular object while the second (lower) jaw swing around the underside of the object such that a free end of the second jaw is locked by a spring-loaded latch that is also pivotally mounted to the handle. The free end of the second jaw must swing into the latch with sufficient momentum to displace the spring-loaded latch into a cavity formed in the handle. If the free end displaces this spring-loaded latch sufficiently inwardly to move beyond the latch, the second clamping jaw becomes locked as the spring-loaded latch returns outwardly to its resting position. The pivotal latch thus acts like a cam as the free slides against the outer surface of the latch. The first and second clamping jaws, when locked, tightly grip the cylindrical or tubular object within semi-circular (round) gripping portions. To unlock the second clamping jaw from the first clamping jaw, the latch is pressed inwardly, i.e. against the outward force exerted by the spring, to thereby release the free end of the second clamping jaw from the latch. The unclamped wrench can then be removed from the object.

Figure 1:
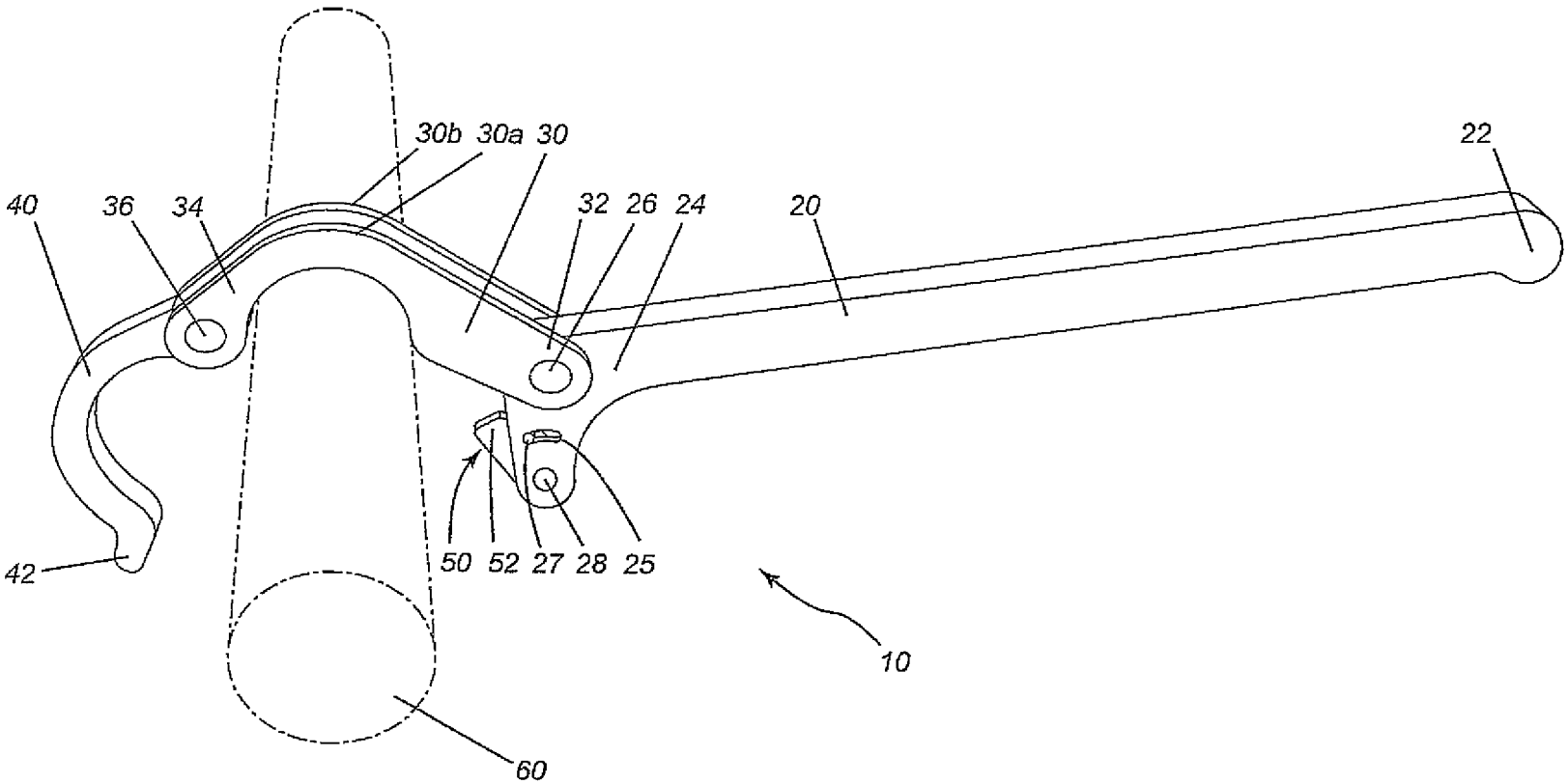
FIG. 1 is a perspective view of a self-clamping wrench in accordance with one embodiment of the present invention.

FIG. 1 depicts a self-clamping wrench in accordance with a main embodiment of the present invention. The wrench, which is designated generally by reference numeral 10, includes an elongated handle 20, a first clamping arm or clamping jaw 30, a second clamping arm or clamping jaw 40 and a spring-loaded latch mechanism 50. The clamping jaws (clamping arms) of this particular version of the wrench are designed to clamp around a cylindrical or tubular object 60 with a generally round or circular cross-section or profile.

In the particular embodiment depicted in FIG. 1, the elongated handle 20 has a proximal end 22 and a distal end 24. The proximal end is the end closest to the body of the user when the user grips the handle with the clamping arms/jaws facing away from the user. The elongated handle is preferably designed for two-handed gripping and operation but may in theory be operated single-handedly. Optionally, moulded or rubberized hand grips may be provided on the handle. At the distal end of the handle are a first pivot 26 and a second pivot 28. The first pivot connects to the first clamping jaw 30. The second pivot connects to the spring-loaded latch mechanism 50. This spring-loaded latch mechanism comprises a spring-loaded latch 52 that is pivotally connected to the second pivot 28. The latch 52 is thus movable about the second pivot from an unlocked position to a locked position.

As further depicted in FIG. 1, the first clamping jaw includes a first end 32 pivotally connected to the handle 20 at the first pivot 26 and having a second end 34 that includes a third pivot 36.

As further depicted in FIG. 1, the second clamping jaw 40 is pivotally connected to the first clamping jaw 30 via the third pivot 36 to constitute with the first clamping jaw an articulated clamping jaw. The second clamping jaw 40 has a free end 42 for displacing the spring-loaded latch 52 from the unlocked position to the locked position, the latch 52 locking the free end of the second clamping jaw when the free end of the second clamping jaw has pushed past the latch 52.

The first ("upper") clamping jaw 20 may be made of a single unitary jaw or two substantially identical jaw components spaced apart by a small gap as to allow connection to the narrower handle via a pin joint (or equivalent) at the first pivot 26 such as in the manner shown in FIG. 1. The spaced-apart jaw components 30*a*, 30*b* of the upper jaw (first jaw) also allow connection by a pin joint (or equivalent) to the narrower second clamping arm (second jaw). As will be appreciated, the specific construction details of this embodiment are presented solely by way of example. The wrench first and second jaws may be constructed and interconnected in various other ways, as will be appreciated by those of ordinary skill in the art, without departing from the underlying inventive concept.

In one embodiment, as depicted in FIG. 1, the free end (distal end) of the second clamping jaw 40 may be hooked (bent) to better engage the latch 52 (i.e. to lock against the latch when the free end pushes past the latch).

In one embodiment, as depicted in FIG. 1, the handle 20 includes a cavity or internal space into which the latch may retreat when depressed by the free end of the second clamping jaw.

As further illustrated, the handle 20 may also include a guide groove 25 (such as, for example, the curved guide groove shown in FIG. 1). A pin 27 connected to the latch slides within this guide groove, thereby constraining and limiting the rotational motion of the latch. In the embodiment shown, the guide groove subtends an angle that is equal to or slightly greater than the angle that the latch must rotate to allow the free end of the second clamping arm to push past the latch.

The first and second clamping arms (jaws) may have semi-circular grips or gripping portions having the same radius of curvature as the cylindrical or tubular object they are designed to clamp so as to fit snugly around the cylindrical or tubular object when the free end is latched into the locked position.

FIGS. 2A to 2D illustrate operation of the embodiment of the wrench introduced in FIG. 1. These four illustrations show the kinematics of the linkages of the wrench as it is swung into clamping engagement with a cylindrical object.

Figure 2A:
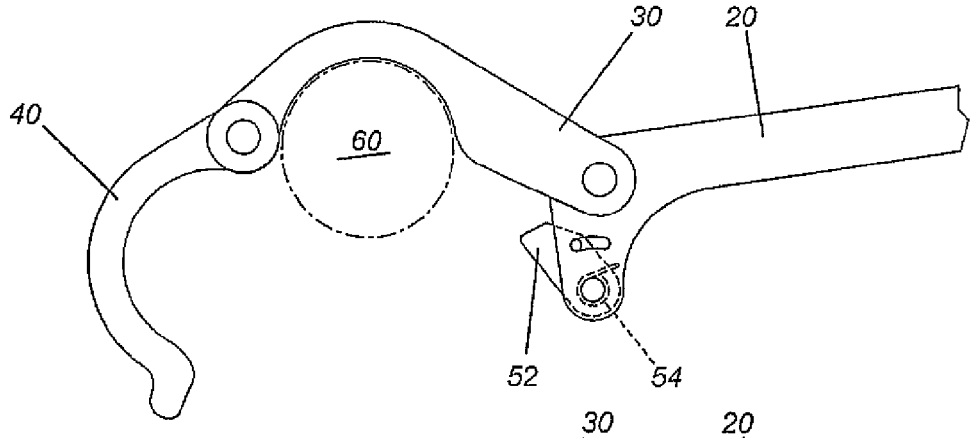
FIG. 2A is a side elevation view of self-clamping wrench of FIG. 1, depicting the first jaw contacting a top side of a cylindrical or tubular object that is to be clamped.
Figure 2B:
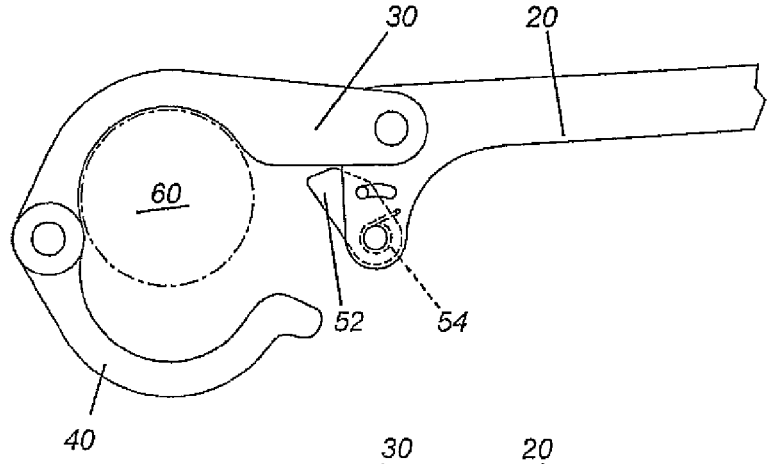
FIG. 2B is a side elevation view of the wrench of FIG. 1, depicting the second jaw pivoting around the bottom side of the cylindrical or tubular object to be clamped.
Figure 2C:
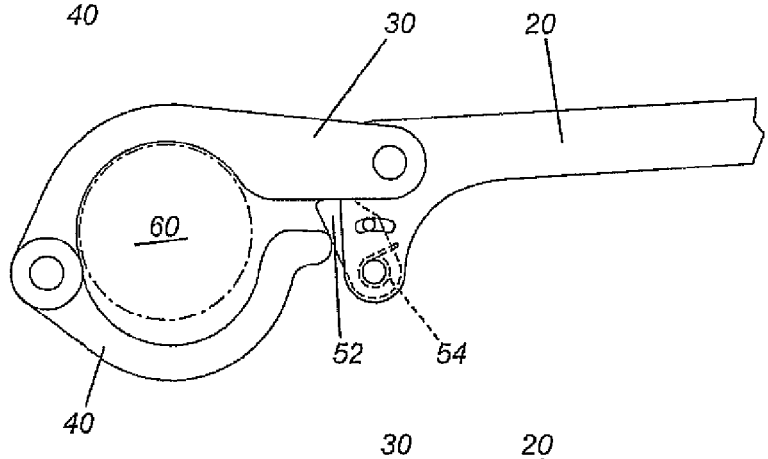
FIG. 2C is a side elevation view of the wrench of FIG. 1, depicting the free end of the second jaw pressing against and rotationally displacing the spring-loaded latch.
Figure 2D:
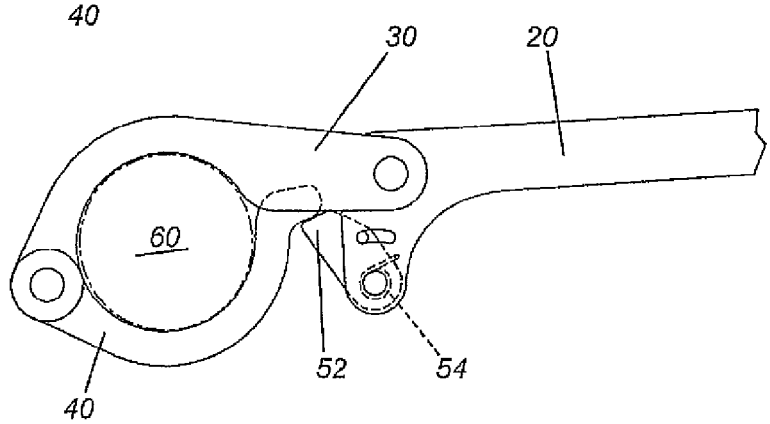
FIG. 2D is a side elevation view of the wrench of FIG. 1, depicting the free end of the second jaw locked by the spring-loaded latch.

Initially, the wrench is swung onto the cylindrical or tubular object to be clamped such that the semi-circular gripping portion of the first arm (first jaw) contacts (engages) the top side of the cylindrical/tubular object, as shown in FIG. 2A. Due to the articulation (pivot connection joining the first and second arms), the second arm wraps underneath the cylindrical/tubular object, as shown in FIG. 2B. Due to the momentum of the second clamping arm, this arm swings upwardly into engagement with the latch, pushing and displacing the latch into the cavity formed in the handle, as shown in FIG. 2C. The free end continues to displace the latch until the free end has moved past the latch, as illustrated in FIG. 2D, whereupon the spring-loaded latch moves back toward its original position, thereby locking the free end of the second jaw tightly against the first jaw. As shown in FIGS. 2A-2D, the spring-loaded latch 52 may be connected to a torsional coil spring mounted about the pivot second pivot 28 to resist rotation of the latch (and thus to urge the latch back to its original resting position when the latch is rotated).

There are a number of different embodiments of this wrench. In a first embodiment, the wrench exploits the inertia of the various components to wrap the clamping jaws around the cylindrical/tubular object. In other words, by accelerating the handle faster than the jaws, the jaws can be made to whip around the object, locking automatically into the latch mechanism.

In further embodiments, the wrench further includes a jaw-positioning mechanism. This jaw-positioning mechanism enables the top jaw (or top pair of jaws) to be pre-positioned in a predetermined posture prior to actuation or engagement of the self-clamping wrench.

Figure 3:
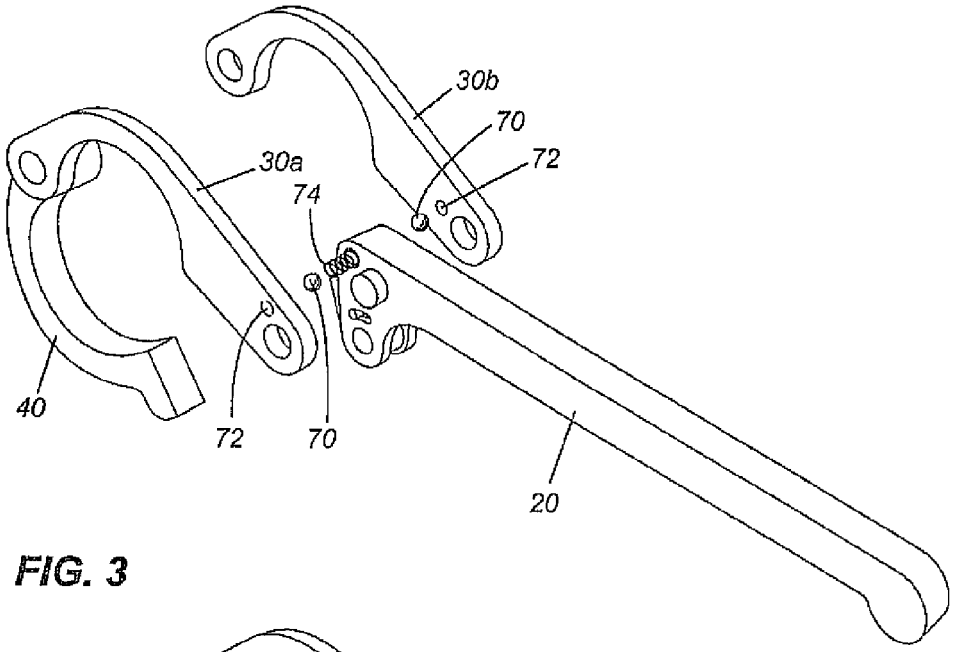
FIG. 3 is a perspective view of another embodiment of the wrench having a spring and ball-detent mechanism for pre-positioning the first jaw in a predetermined posture prior to engagement of the wrench.

Accordingly, in a second embodiment depicted in FIG. 3, a spring and ball-detent mechanism acts on the top jaw(s) to pre-position the top jaw(s) prior to actuation/engagement of the self-clamping wrench. In FIG. 3, the ball 70 engages an appropriately sized detent 72 formed in the inside surface of the jaw components 30*a*, 30*b*. A spring 74 urges the ball into the detent. In the specific embodiment shown, there are two balls and detents on each of the two jaw components of the upper jaw. A single spring may be installed in a hole in the handle so as to act on each ball concurrently. Alternatively, two springs may be provided on each side of the handle to act on respective balls.

Figure 4:
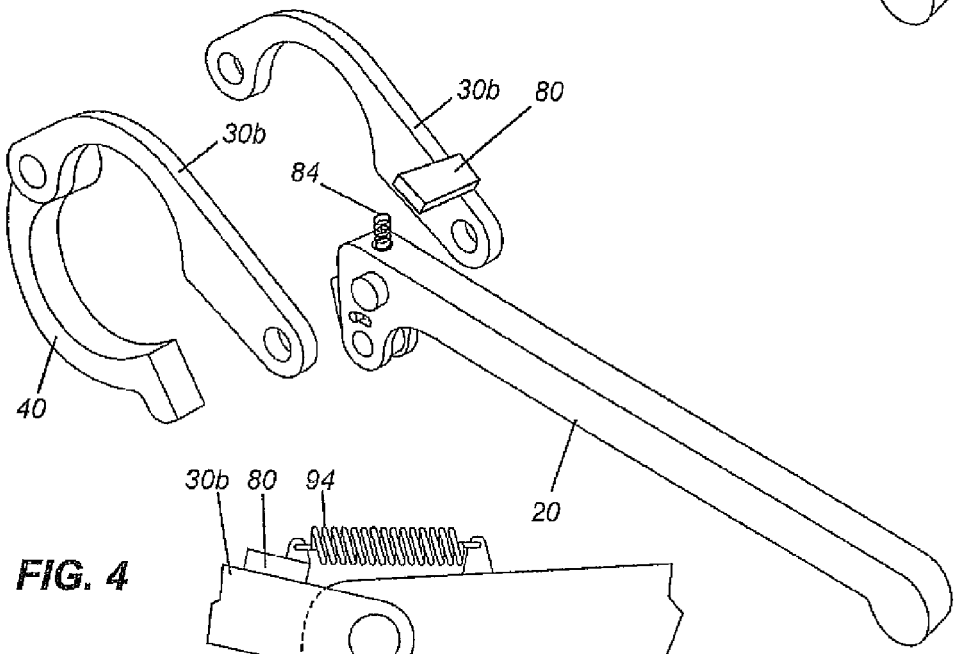
FIG. 4 is a perspective view of another embodiment of the wrench having a compression spring acting on an underside of a jaw bridge for pre-positioning the first jaw in a predetermined posture prior to engagement of the wrench.
Figure 5:
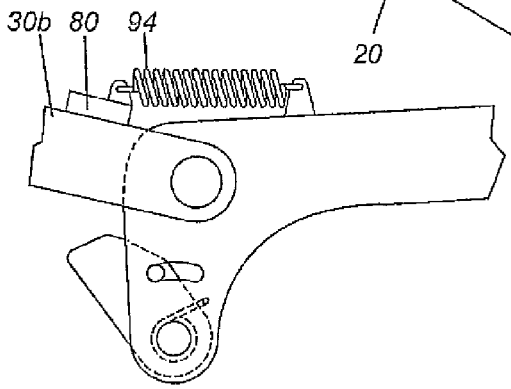
FIG. 5 is a side elevation view of another embodiment of the wrench having a tension spring acting on the top side of a jaw bridge for pre-positioning the first jaw in a predetermined posture prior to engagement of the wrench.

In a third embodiment depicted in FIG. 4, a compression spring 84 acts on a jaw bridge 80 that spans across the top jaws 30*a*, 30*b*. In a fourth embodiment depicted in FIG. 5, which is similar to the embodiment depicted in FIG. 4, a tension spring 94 acts on the top side of the jaw bridge 80. These various mechanisms hold the top jaw(s) in place. The idea is to prepare the wrench manually by pulling (pre-positioning) the top jaw into an open (ready) position so to provide proper clearance. The jaw-positioning mechanism, be it a spring and ball-detent, compression spring or tension spring, will hold the upper jaw in place. This obviates the need to snap the wrench to create the requisite clearance. Accordingly, by pre-positioning the upper law using a jaw-positioning mechanism, the sole purpose of snapping the wrench is to wrap the bottom jaw around the underside of the innertube (or other cylindrical object).

The novel wrench also serves as a tool that enables a novel method of applying torque to a substantially cylindrical object. This novel method entails first gripping an elongated handle of a wrench. The wrench, as described above, has first and second clamping jaws that are pivotally connected to form an articulated clamping jaw that is also pivotally mounted at a proximal end of the first clamping jaw to a distal end of the handle. Next, the user swings the wrench to cause the first clamping jaw to contact one side of the cylindrical object. This causes the second clamping jaw to pivot around the cylindrical object until a free end of the second clamping jaw engages a spring-loaded latch pivotally mounted to the handle. Thus locks the second clamping jaw to the first clamping jaw (and thus tightly grips the cylindrical object between the first and second clamping jaws). Finally, the user rotates the wrench about an axis of the cylindrical object to thus apply torque to the cylindrical object.

This method is most useful in the context of dismantling an innertube from a diamond drill string. However, it may be used in many other contexts as well to apply torque to an object that is cylindrical or tubular. As will be appreciated, the semi-circular gripping portions could modified to have any other shape to thus grip onto a non-circular object. In other words, this wrench technology is not necessarily limited to a wrench having semi-circular grips.

This method enables a single user to quickly and easily clamp the wrench and apply torque. A corollary benefit of this new self-clamping wrench technology is that a single user can sequentially clamp two such wrenches, i.e. clamp a first wrench and then clamp a second wrench (while maintaining the first wrench in a clamped position). This enables a user to clamp two such wrenches to two connected components or parts, e.g. an innertube and the rest of the drill string, and then to apply equal and opposite torques to disconnect the two connected components.

This invention has been described in terms of specific examples, embodiments, implementations and configurations which are intended to be exemplary only. Persons of ordinary skill in the art will appreciate that obvious variations, modifications and refinements will become apparent from the present disclosure and that these can be made without departing from the scope of the present invention. The scope of the exclusive right sought by the Applicant is therefore intended to be limited solely by the appended claims.

The invention claimed is:

1. A wrench comprising:

an L-shaped handle having an elongated member defining a proximal end and a distal end, the handle defining a top side and a bottom side, also having a short downward extension defining a cavity integrally formed with the elongated member at said distal end and extending away from the top side, the handle having:

a first pivot at the distal end;

a second pivot on the short downward extension of the L-shaped handle;

a spring-loaded latch pivotal within the cavity and pivotally connected to the second pivot and extending toward the top side from the second pivot, the latch being movable about the second pivot from an unlocked position to a locked position by pivoting toward the proximal end;

a pin attached to the latch, the pin slides within a guide groove formed on the short downward extension to limit rotational motion of the latch;

a first clamping jaw having a first end pivotally connected to the handle at the first pivot and having a second end that includes a third pivot; and a second clamping jaw pivotally connected to the first clamping jaw via the third pivot to constitute with the first clamping jaw an articulated clamping jaw, the second clamping jaw having a free end for displacing the spring-loaded latch from the unlocked position to the locked position, the latch locking the free end of the second clamping jaw when the free end of the second clamping jaw has pushed past the latch.

2. The wrench as claimed in claim 1 wherein the free end of the second clamping jaw is hooked to lock against the latch.

3. The wrench as claimed in claim 1 wherein the first and second clamping jaws each comprises a semi-circular gripping portion for engaging a rounded outside surface of a cylindrical object.

4. A method for applying torque to a substantially cylindrical object, the method comprising:

gripping an elongated L-shaped handle of a wrench having first and second clamping jaws that are pivotally connected to form an articulated clamping jaw that is also pivotally mounted at a proximal end of the first clamping jaw to a distal end of the handle, wherein the L-shaped handle has an elongated member defining a proximal end and a distal end, the handle defining a top side and a bottom side, also having a short downward extension defining a cavity integrally formed with the elongated member at said distal end and extending away from the top side;

swinging the wrench to cause the first clamping jaw to contact one side of the cylindrical object, thus causing the second clamping jaw pivotally connected to the first clamping jaw to pivot around the cylindrical object until a free end of the second clamping jaw engages a spring-loaded latch pivotally mounted within the cavity and extending toward the to side from the second pivot, thereby causing the latch to pivot toward the proximal end of the handle wherein a in attached to the latch slides within a guide groove formed on the short downward extension to limit rotational motion of the latch thereby locking the second clamping jaw to the first clamping jaw to tightly grip the cylindrical object between the first and second clamping jaws; and rotating the wrench about an axis of the cylindrical object to thereby apply torque to the cylindrical object.

5. The method as claimed in claim 4 further comprising setting the first clamping jaw in a predetermined posture to facilitate locking of the wrench around the cylindrical object.

6. A method of disconnecting two connected substantially cylindrical or tubular objects by applying equal and opposite torques to the two connected objects using first and second clamping wrenches, the method comprising: gripping an elongated L-shaped handle of the first wrench having first and second clamping jaws that are pivotally connected to form an articulated clamping jaw that is also pivotally mounted at a proximal end of the first clamping jaw to a distal end of the handle, wherein the L-shaped handle has an elongated member defining a proximal end and a distal end, the handle defining a top side and a bottom side, also having a short downward extension defining a cavity integrally formed with the elongated member at said distal end and extending away from the top side;

swinging the first wrench to cause the first clamping jaw to contact one side of the cylindrical object, thus causing the second clamping jaw pivotally connected to the first clamping law to pivot around the cylindrical object until a free end of the second clamping jaw engages a spring-loaded latch pivotally mounted within the cavity and extending toward the to side from the second pivot, thereby causing the latch to pivot toward the proximal end of the handle wherein a in attached to the latch slides within a guide groove formed on the short downward extension to limit rotational motion of the latch thereby locking the second clamping jaw to the first clamping jaw to tightly grip the cylindrical object between the first and second clamping jaws;

gripping an elongated L-shaped handle of the second wrench having first and second clamping jaws that are pivotally connected to form an articulated clamping jaw that is also pivotally mounted at a proximal end of the first clamping jaw to a distal end of the handle, wherein the L-shaped handle has an elongated member defining a proximal end and a distal end, the handle defining a top side and a bottom side, also having a short downward extension defining a cavity integrally formed with the elongated member at said distal end and extending away from the top side;

swinging the second wrench to cause the first clamping jaw to contact one side of the cylindrical object, thus causing the second clamping jaw pivotally connected to the first clamping jaw to pivot around the cylindrical object until a free end of the second clamping jaw engages a spring-loaded latch pivotally mounted within the cavity and extending toward the top side from the second pivot, thereby causing the latch to pivot toward the proximal end of the handle wherein a pin attached to the latch slides within a guide groove formed on the short downward extension to limit rotational motion of the latch thereby locking the second clamping jaw to the first clamping jaw to tightly grip the cylindrical object between the first and second clamping jaws; and rotating one of the first and second wrenches relative to the other of the first and second wrenches to thereby apply equal and opposite torques to the two connected objects.

7. The method as claimed in claim 6 further comprising setting the first clamping jaw of the first wrench and of the second wrench in respective predetermined postures to facilitate locking of the wrenches around the respective cylindrical objects.

8. The method as claimed in claim 6 further comprising releasing the second clamping jaw from its respective latch for each of the first and second wrenches by pressing each latch inwardly so that each latch clears the free end of the respective second clamping jaw.

9. The method as claimed in claim 7 further comprising releasing the second clamping jaw from its respective latch for each of the first and second wrenches by pressing each latch inwardly so that each latch clears the free end of the respective second clamping jaw.

* * * * *